US005515927A

United States Patent [19]

Matsushita et al.

[11] Patent Number: 5,515,927

[45] Date of Patent: May 14, 1996

[54] CONTROL UNIT FOR CONTROLLING LOAD ON A BULLDOZER IN THE CASE OF MANUAL INTERVENTION

[75] Inventors: Shigenori Matsushita; Shu H. Zhang; Shigeru Yamamoto; Satoru Nishita; Kazushi Nakata, all of Hirakata, Japan

[73] Assignee: Kabushiki Kaisha Komatsu Seisakusho, Tokyo, Japan

[21] Appl. No.: 255,725

[22] Filed: Jun. 7, 1994

[30] Foreign Application Priority Data

Jun. 8, 1993 [JP] Japan ..... 5-137927

[51] Int. Cl.[6] ..... A01B 67/00

[52] U.S. Cl. ..... 172/3; 172/9; 172/4.5; 364/424.07

[58] Field of Search ..... 172/2, 3, 4, 4.5, 172/7, 9, 821; 364/424.07; 414/699; 37/348, 907, 382

[56] References Cited

U.S. PATENT DOCUMENTS

| | | | |
|---|---|---|---|
| 4,062,539 | 12/1977 | Tetsuka et al. | 172/7 X |
| 4,282,933 | 8/1981 | Suganami et al. | 172/4.5 |
| 4,423,785 | 1/1984 | Kurihara et al. | 172/7 X |
| 4,630,685 | 12/1986 | Huck, Jr. et al. . | |
| 4,807,131 | 2/1989 | Clegg | 172/4.5 X |
| 4,846,283 | 7/1989 | Batcheller | 172/7 X |
| 4,934,463 | 6/1990 | Ishida et al. | 172/4.5 |
| 5,065,326 | 11/1991 | Sahm | 364/424.07 |
| 5,224,033 | 6/1993 | Nakamura et al. | 364/424.07 X |
| 5,359,517 | 10/1994 | Moriya et al. | 364/424.07 |
| 5,398,766 | 3/1995 | Nakayama et al. | 172/2 X |

FOREIGN PATENT DOCUMENTS

| | | | |
|---|---|---|---|
| 53-6967 | 2/1978 | Japan . | |
| 53-5441 | 2/1978 | Japan . | |
| 55-36776 | 9/1980 | Japan . | |
| 63-31618 | 6/1988 | Japan . | |
| 1-62525 | 3/1989 | Japan . | |
| 3-43523 | 2/1991 | Japan . | |
| 9218706 | 10/1992 | Japan | 364/424.07 |
| 6-3886 | 2/1994 | Japan . | |

*Primary Examiner*—Dave W. Arola
*Assistant Examiner*—Victor Batson
*Attorney, Agent, or Firm*—Armstrong, Westerman, Hattori, McLeland & Naughton

[57] ABSTRACT

A control unit for controlling load on a bulldozer in the case of manual intervention, comprising: an actual tractive force detector for detecting the actual tractive force of a vehicle body; a target tractive force setting device for setting a target tractive force for an automatic blade control mode in dozing operation according to the actual tractive force detected by the actual tractive force detector; and a blade controller for controlling a blade to be lifted or lowered such that, if there is a difference between the target tractive force set by the target tractive force setting device when switching from the automatic blade control mode to a manual operation mode takes place in dozing operation and the actual tractive force detected by the actual tractive force detector when return from the manual operation mode to the automatic blade control mode takes place, the actual tractive force gradually comes closer to the target tractive force set when switching to the manual operation mode takes place.

17 Claims, 8 Drawing Sheets

CONTROL UNIT FOR CONTROLLING LOAD ON A BULLDOZER IN THE CASE OF MANUAL INTERVENTION

BACKGROUND OF THE INVENTION (1) Field of the Invention

The present invention relates to techniques for controlling the load which is applied to the blade of a bulldozer due to its digging and carrying operations when manual operation intervenes in dozing operations carried out in an automatic blade control mode.

(2) Description of the Prior Art

Dozing operation by the use of a bulldozer has been previously performed in such a way that, by fully manual operation of the operator who drives a bulldozer, a blade to be lifted or lowered is so operated that the load applied to the blade during digging and carrying can be kept substantially constant.

SUMMARY OF THE INVENTION

Such manual operation for lifting or lowering a blade so as to keep the load on the blade substantially constant for getting good efficiency has the disadvantage that it brings tremendous fatigue to the operator, even if he is very skillful, since he has to carry out lifting/lowering operation a number of times. Another disadvantage is that the above operation itself is very complicated and difficult to carry out not only for unskilled operators who soon get exhausted but also for experienced operators.

One proposal to solve the above problems would be a load control unit for a bulldozer, in which the actual tractive force of the vehicle body is detected and this detected tractive force is made to be equal to a preset target tractive force, whereby the load applied to the blade is controlled to be constant.

Even if a bulldozer having the above-described load control unit is used, it is not possible to perform dozing operation in automatic blade control modes all the time and therefore the operator intervenes for manual operation if the need arises. In cases where manual operation intervenes in dozing operations carried out in an an automatic blade control mode, in other words, in cases where manual intervention takes place in automatic driving, there is a strong likelihood that when returning to the automatic blade control mode after manual intervention, the control unit fails in smooth transfer from the manual operation mode to the automatic blade control mode, causing an abrupt movement of the blade or a sudden increase in the load applied to the blade, because the load applied to the blade varies depending on the contents of the dozing operation at the time of manual intervention. This gives a feeling of disorder to the operator and disallows smooth dozing operation.

The invention has been made in order to overcome the above problem, and an object of the invention is therefore to provide a control unit for controlling load in a bulldozer in the case of manual intervention, in which after manual intervention by the operator has taken place during dozing operation in an automatic blade control mode, return to automatic driving can be smoothly performed without causing an abrupt movement of the blade.

In order to accomplish the above objective there is provided, according to the invention, a control unit for controlling load in a bulldozer in the case of manual intervention, comprising:

(a) actual tractive force detector means for detecting the actual tractive force of a vehicle body;

(b) target tractive force setting means for setting a target tractive force for an automatic blade control mode in dozing operation in accordance with the actual tractive force detected by the actual tractive force detector means; and (c) blade controller means for controlling a blade to be lifted or lowered such that if there is a difference between the target tractive force set by the target tractive force setting means when switching from the automatic blade control mode to a manual operation mode takes place in dozing operation and the actual tractive force detected by the actual tractive force detector means when return from the manual operation mode to the automatic blade control mode takes place, the actual tractive force gradually comes closer to the target tractive force set when switching to the manual operation mode takes place.

In the control unit of the invention, when dozing operation in the automatic blade control mode is switched to the manual operation mode by the intervention of the operator and the automatic blade control mode is resumed thereafter, the blade is lifted or lowered such that the actual tractive force comes gradually closer to the target tractive force set when switching to the manual operation mode takes place, if there is a difference between the target tractive force set by the target tractive force setting means when switching from the automatic blade control mode to the manual operation mode takes place and the actual tractive force detected by the actual tractive force detector means when return from the manual operation mode to the automatic blade control mode takes place. After all, the magnitude of the load applied to the blade during digging or carrying is maintained constant so as to make the actual tractive force equal to the target tractive force.

With such an arrangement, when manual intervention takes place in dozing operation being carried out in the automatic blade control mode, load control at the time of return from the manual operation mode to the automatic blade control mode can be smoothly performed without causing an abrupt move of the blade as well as a sudden increase in the load. This ensures smooth dozing operation.

Preferably, the blade controller means controls the blade to be held in a predetermined position for a specified time after return from the manual operation mode to the automatic blade control mode. This allows the return to the automatic blade control mode after manual intervention to be carried out more smoothly.

There may be provided, as the automatic blade control mode, an automatic digging mode associated with digging in dozing operation and an automatic carrying mode associated with carrying in dozing operation.

The control when returning from the manual operation mode to the automatic blade control mode after manual intervention can be more accurately performed by taking different ways in operating the blade and setting a target tractive force as described below, depending on conditions such as (i) whether the driving mode resumed after the return is the automatic digging mode or the automatic carrying mode; (ii) which is greater the target tractive force at the time of manual intervention or the actual tractive force at the time of the return to the automatic blade control mode; (iii) the degree of the difference between the above target tractive force and actual tractive force; (iv) a speed range selected by the transmission; and (v) the magnitude of the actual tractive force detected.

1. Where the automatic blade control mode resumed after return from the manual operation mode is the automatic digging mode:

(1) If the target tractive force when switching from the automatic blade control mode to the manual operation mode takes place is greater than the actual tractive force when return from the manual operation mode to the automatic blade control mode takes place, and if the difference between the target tractive force and the actual tractive force exceeds a specified value, the blade is controlled by the blade controller means to be lowered gradually for a specified time. In this case, the specified time is preferably set in accordance with the degree of the difference between the target tractive force when switching from the automatic blade control mode to the manual operation mode takes place and the actual tractive force when return from the manual operation mode to the automatic blade control mode takes place.

(2) If the target tractive force when switching from the automatic blade control mode to the manual operation mode takes place is greater than the actual tractive force when return from the manual operation mode to the automatic blade control mode takes place and if the difference between these target tractive force and actual tractive force is within the specified value, the target tractive force setting means sets a target tractive force so as to gradually increase, being made closer to the target tractive force set when switching from the automatic blade control mode to the manual operation mode takes place.

(3) If the target tractive force when switching from the automatic blade control mode to the manual operation mode takes place is smaller than the actual tractive force when return from the manual operation mode to the automatic blade control mode takes place, the target tractive force setting means sets a target tractive force which is equal to the target tractive force when switching from the automatic blade control mode to the manual operation mode takes place.

2. Where the automatic blade control mode resumed after return from the manual operation mode is the automatic carrying mode:

(1) If the target tractive force when switching from the automatic blade control mode to the manual operation mode takes place is greater than the actual tractive force when return from the manual operation mode to the automatic blade control mode takes place, the blade is controlled by the blade controller means to be gradually lowered for a specified time. In this case, the specified time is preferably set according to the degree of the difference between the target tractive force when switching from the automatic blade control mode to the manual operation mode takes place and the actual tractive force when return from the manual operation mode to the automatic blade control mode takes place and according to a speed range selected by the transmission. Preferably, the specified time set when a second forward speed is selected is greater than the specified time set when a first forward speed is selected. Further, the specified time may be set according to the degree of the difference between the target tractive force when switching from the automatic blade control mode to the manual operation mode takes place and the actual tractive force when return from the manual operation mode to the automatic blade control mode takes place; according to a speed range selected by the transmission; and according to the magnitude of the actual tractive force detected by the actual tractive force detector means. In this case, it is preferable that the specified time set when the second forward speed is selected is greater than the specified time set when the first forward speed is selected, and the specified time set when the actual tractive force is great is smaller than the specified time set when the actual tractive force is small.

(2) If the target tractive force when switching from the automatic blade control mode to the manual operation mode takes place is smaller than the actual tractive force when return from the manual operation mode to the automatic blade control mode takes place, the target tractive force setting means sets a target tractive force so as to gradually decrease, being closer to the target tractive force set when switching from the automatic blade control mode to the manual operation mode takes place.

Detection of the actual tractive force by the actual tractive force detector means is performed in either of the following ways.

1. An engine revolution sensor for detecting the revolution speed Ne of an engine and a torque convertor output shaft revolution sensor for detecting the revolution speed Nt of the output shaft of a torque convertor are employed. A speed ratio e (=Nt/Ne), which is the ratio of the engine revolution speed Ne detected by the engine revolution sensor to the torque convertor output shaft revolution speed Nt detected by the torque convertor output shaft revolution sensor, is first obtained. Then, torque convertor output torque is obtained from the torque convertor characteristic of the torque convertor, using the speed ratio e. The torque convertor output torque thus obtained is then multiplied by the reduction ratio between the output shaft of the torque convertor and sprockets for driving the crawler belts used for running the vehicle body, whereby the actual tractive force of the vehicle body is detected.

2. An engine revolution sensor for detecting the revolution speed of an engine is used, when the torque convertor equipped with a lock-up mechanism is "locked up" or when a direct transmission is employed. Engine torque is obtained from the engine torque characteristic of the engine, using the revolution speed of the engine detected by the engine revolution sensor. Then, the engine torque thus obtained is multiplied basically by the reduction ratio between the engine and the sprockets for driving the crawler belts used for running the vehicle body, and accordingly, the actual tractive force of the vehicle body is detected.

The actual tractive force detector means may be equipped with a pitch angle sensor for detecting the pitch angle of the vehicle body inclining in forward and backward directions and the actual tractive force which has been detected by the detector means may be corrected in accordance with the pitch angle detected by the pitch angle sensor. This allows the load applied to the blade during digging or carrying to be maintained constant irrespective of running resistance which is dependent on the pitch angle of the vehicle body, that is, the angulation of the ground where the vehicle runs.

The control of lifting or lowering the blade of the blade controller means is not performed when the blade is in manual operation, but performed when the blade is in the automatic blade control mode and the first forward speed or second forward speed is selected. This makes it possible to perform automatic driving only when a speed suitable for dozing operation such as the first forward speed or second forward speed is selected in the automatic blade control mode. The manual operation of the blade is carried out in preference to the automatic driving and, therefore, can be performed any time at will, by intervening it in the course of automatic blade control.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and accompanying drawings which are given by way of illustration only, and thus are not limitative of the present invention, and wherein:

FIGS. 1 to 9 illustrate a preferred embodiment of a control unit for controlling load in a bulldozer in the case of manual intervention, according to the invention;

FIG. 1 is an external appearance of the bulldozer;

FIG. 2 is a skeleton diagram of a power transmission system;

FIG. 3 is a schematic block diagram of the overall construction of the control unit;

FIGS. 5 to 9 are a graph showing a curved engine characteristic map; graph showing a pump correction characteristic map; graph showing a curved torque converter characteristic map; graph showing a pitch angle-load correction value characteristic map; and graph showing a load control characteristic map, respectively.

PREFERRED EMBODIMENTS OF THE INVENTION

With reference to the drawings, a control unit for controlling load in a bulldozer in the case of manual intervention according to a preferred embodiment of the invention will be hereinafter described.

Figure 1:
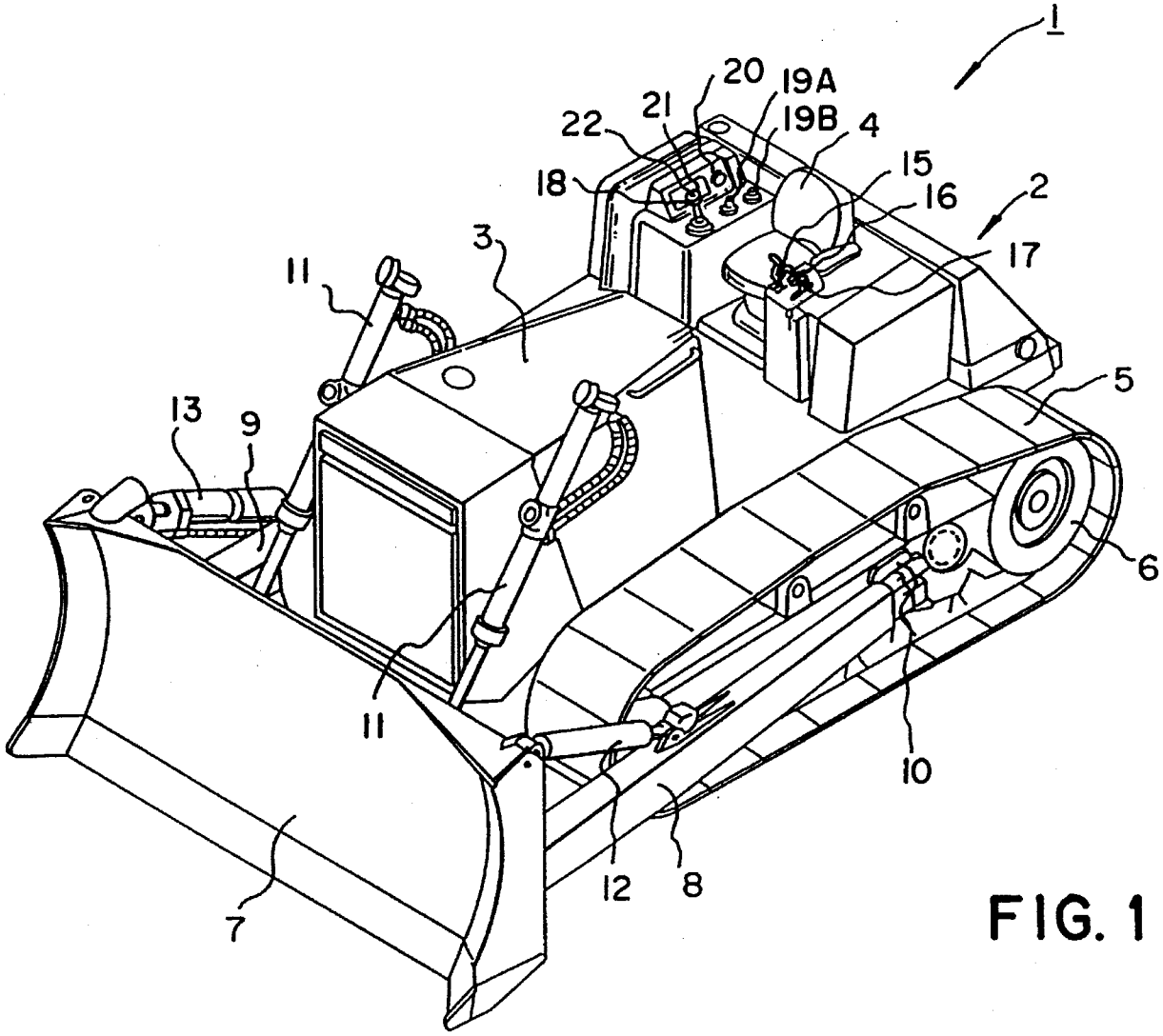

Referring to FIG. 1, there is shown the external appearance of a bulldozer 1 which is provided with, on a vehicle body 2 thereof, a bonnet 3 for housing an engine (not shown) and an operator seat 4 for the operator who drives the bulldozer 1. Both sides (i.e., the right and left sides of the vehicle body 2 when viewed in its moving direction) of the vehicle body 2 are provided with crawler belts 5 (the crawler belt on the right side is not shown) for running the vehicle body 2 so as to turn or move back and forth. Each of these crawler belts 5 are independently driven by their respective sprockets 6 actuated by driving force transmitted from the engine.

There are provided straight frames 8, 9 for supporting a blade 7 at the forward ends thereof. The base ends of these right and left straight frames 8, 9 are pivotally supported at the right and left sides of the vehicle body 2 by means of trunnions 10 (the trunnion on the right side is not shown) in such a manner that the blade 7 can be lifted or lowered. Disposed between the blade 7 and the vehicle body 2 are right and left blade lift cylinders 11 forming a pair for lifting or lowering the blade 7. For functioning to incline the blade 7 to the right and left, a brace 12 is disposed between the blade 7 and the left straight frame 8 and a blade tilt cylinder 13 is disposed between the blade 7 and the right straight frame 9.

There are provided a steering lever 15, a transmission shift lever 16 and a fuel control lever 17 on the left of the operator seat 4 when the vehicle body 2 is viewed in its moving direction. On the right of the operator seat 4, there are provided a blade control lever 18 for lifting, lowering the blade 7 and inclining it to the right and left; a first dial switch 19A for setting a load to be applied to the blade 7 and a second dial switch 19B for correcting the set load by adding or subtracting a correction value; and a lock-up selector switch 20 for bringing a torque convertor into a locked-up state or releasing the torque convertor from the locked-up state; and a display unit 21. The top of the blade control lever 18 is provided with a driving mode selector button 22 for switching driving modes in dozing operation and so on. According to how many times the driving mode selector button 22 is pressed, the driving mode sequentially switches between a manual operation mode, an automatic digging mode and an automatic carrying mode in dozing operation. Although they are not shown in the drawing, a brake pedal and a decelerator pedal are disposed in front of the operator seat 4.

Figure 2:
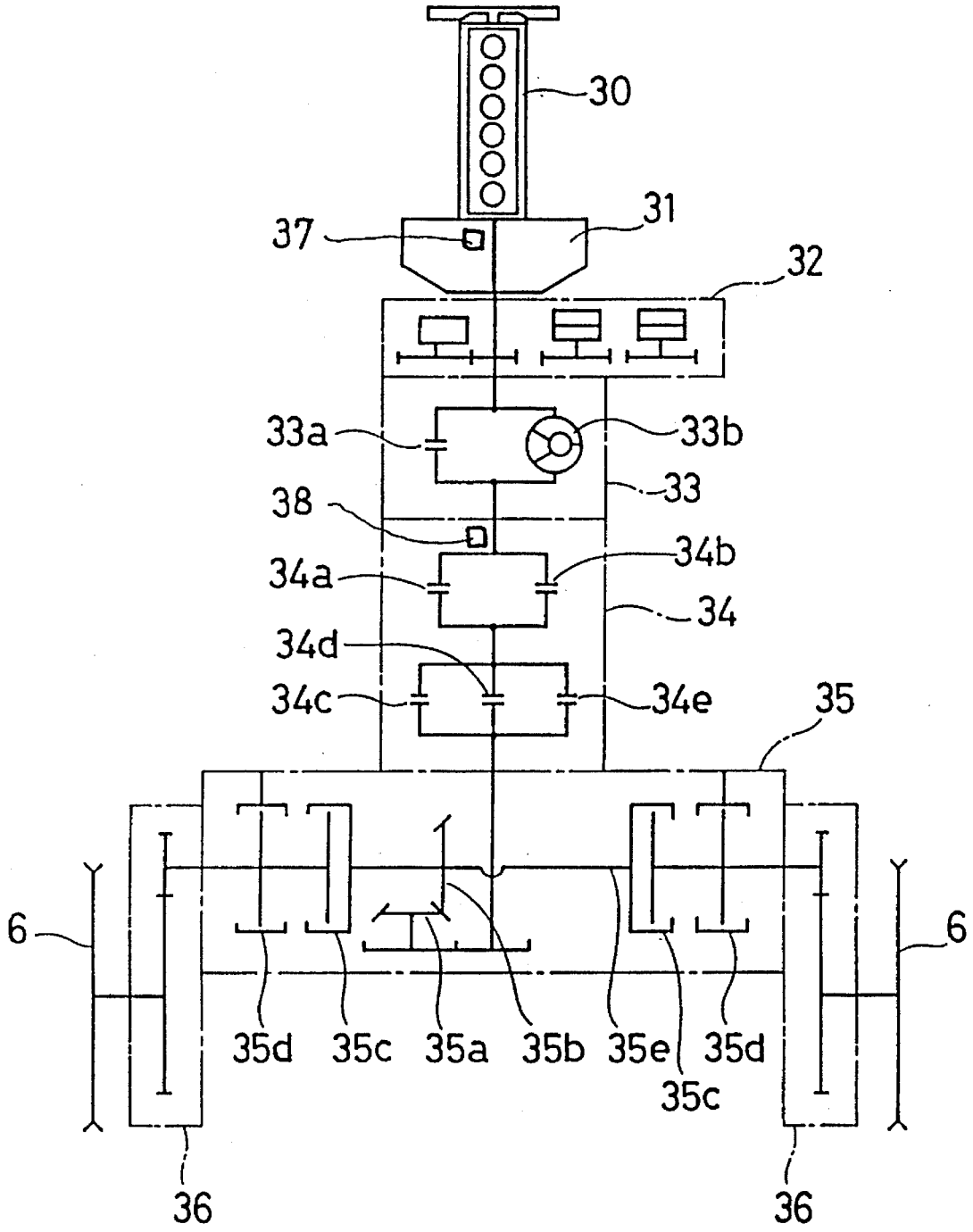

Referring to FIG. 2 which shows a power transmission system, rotary driving force from an engine 30 is transmitted to a torque convertor with a lock-up mechanism 33 through a damper 31 and a PTO 32. The torque convertor with a lock-up mechanism 33 includes a lock-up mechanism 33*a* and a pump 33*b*, and the PTO 32 functions to drive various hydraulic pumps including hydraulic pumps for operational machines. The rotary driving force is then transmitted from an output shaft of the torque convertor with a lock-up mechanism 33 to a transmission 34 such as, for example, a planetary gear lubricated multiple-disc clutch transmission, an input shaft of which is connected to the above output shaft. The transmission 34 includes forward and reverse clutches 34*a*, 34*b* and first to third clutches 34*c* to 34*e* so that the revolution of the output shaft of the transmission 34 can be shifted in three ranges in both forward and backward directions. The rotary driving force from the output shaft of the transmission 34 is transmitted to a steering mechanism 35 that includes a pinion 35 and a transverse shaft 35*e* on which disposed are a bevel gear 35*b*, right and left steering clutches 35*c* forming a pair, and right and left steering brakes 35*d* forming a pair. Thereafter, the rotary driving force is transmitted to a pair of final reduction mechanisms 36 disposed on the right and left hands so that each of the sprockets 6 for running the crawler belts 5 is driven. Reference numeral 37 denotes an engine revolution sensor for detecting the revolution speed of the engine 30 and reference numeral 38 denotes a torque convertor output shaft revolution sensor for detecting the revolution speed of the output shaft of the torque convertor with a lock-up mechanism 33.

Figure 3:
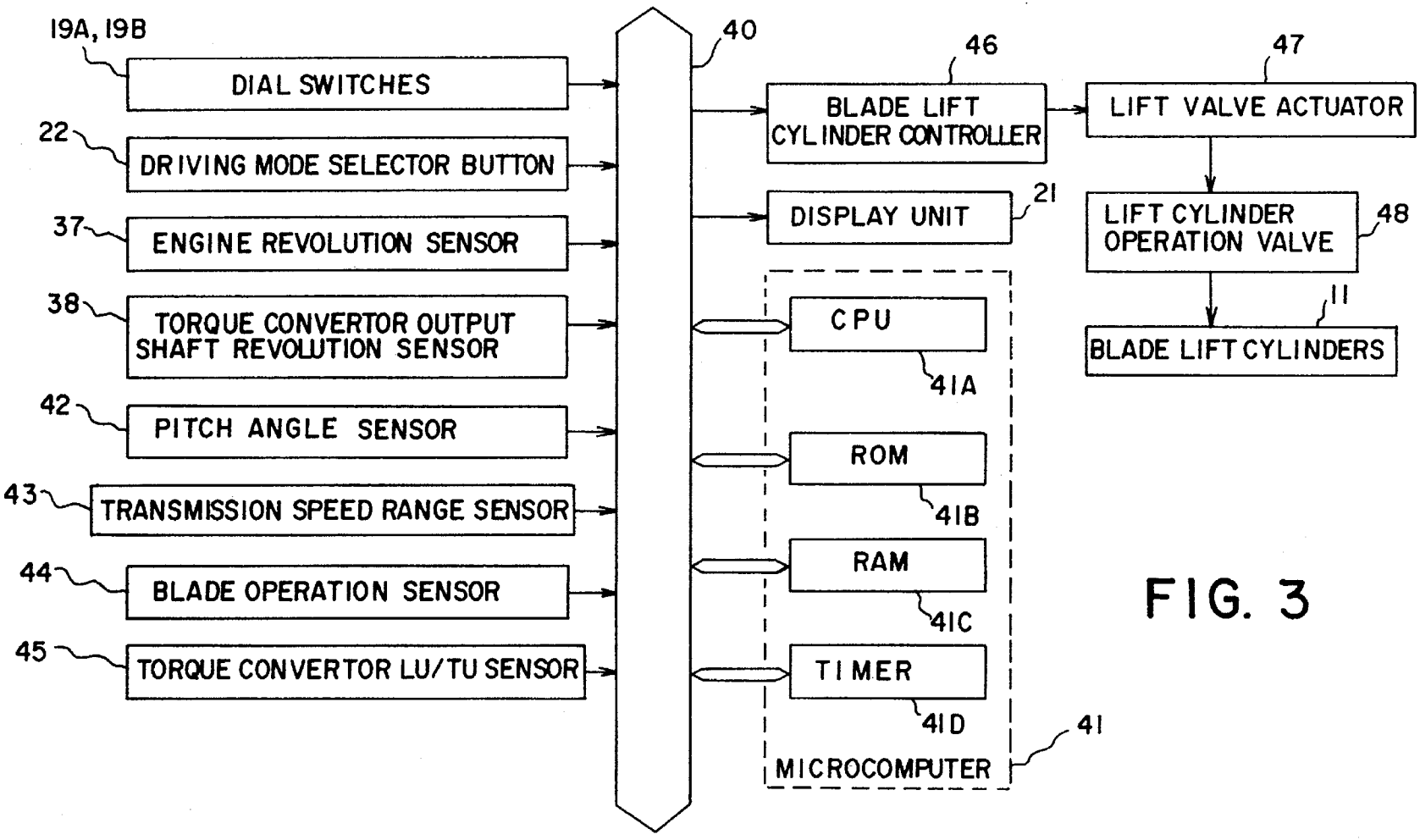

Referring to FIG. 3 which schematically shows the overall construction of the control unit for controlling load in a bulldozer in case of manual intervention according to the invention, the following data items are supplied to a microcomputer 41 through a bus 40: (i) dial value data sent from the first dial switch 19A, regarding the magnitude of a load applied to the blade 7, which load is set by the first dial switch 19A; (ii) dial value data sent from the second dial switch 19B, regarding a correction value to be added to or subtracted from the set load; (iii) data on the pressing operation condition of the driving mode selector button 22 for switching between the manual operation mode, automatic digging mode and automatic carrying mode and so on in dozing operation; (iv) revolution speed data from the engine revolution sensor 37, regarding the revolution speed of the engine 30; and (v) revolution speed data from the torque convertor output shaft revolution sensor 38, regarding the revolution speed of the output shaft of the torque convertor 33. The following data and so on are also supplied to the microcomputer 41 through the bus 40: (i) pitch angle data sent from a pitch angle sensor 42 that detects the momentarily varying pitch angle of the vehicle body 2 inclining in forward and backward directions; (ii) data from a transmission speed range sensor 43 that detects the speed range selecting condition of the transmission 34, regarding a speed range selected by operating the transmission shift lever 16; (iii) data from a blade operation sensor 44 that detects whether or not the blade 7 is manually operated by the blade control lever 18; and (iv) data from a torque convertor LU/TC sensor 45 that detects the locked-up (LU)/torque converting (TC) changing condition of the torque converter 33, the torque convertor 33 being switched between a lock-up on state and lock-up off state with the lock-up selector switch 20.

The microcomputer 41 is composed of a central processing unit (CPU) 41A for executing a specified program; a read only memory (ROM) 41B for storing the above program and various maps such as a curved engine characteristic map and curved torque convertor characteristic map; a random access memory (RAM) 41C serving as a working memory necessary for executing the program and as registers for various data; and a timer 41D for measuring elapsed time for an event in the program. The program is executed in accordance with (i) the dial value data on the set load to be applied to the blade 7; (ii) the dial value data on the correction value to be added to or subtracted from the set load; (iii) the data on the pressing operation condition of the driving mode selector button 22; (iv) the data on the revolution speed of the engine 30; (v) the data on the revolution speed of the output shaft of the torque convertor 33; (vi) the data on the pitch angle of the vehicle body 2 in forward and backward directions; (vii) the data on the speed range selecting condition of the transmission 34; (viii) data on whether or not the blade 7 is in manual operation; and (ix) data on the locked-up (LU)/torque converting (TC) changing condition of the torque converter 33. Then, data on the lift operation amount for lifting or lowering the blade 7 is supplied to a blade lift cylinder controller 46, and the right and left blade lift cylinders 11 are driven based on the lift operation amount by means of the controller 46 with the help of a lift valve actuator 47 and a lift cylinder operation valve 48, whereby the blade 7 is lifted or lowered. The display unit 21 displays information such as whether the bulldozer 1 is presently in the manual operation mode, automatic digging mode or automatic carrying mode and so on in dozing operation.

Figure 4A:
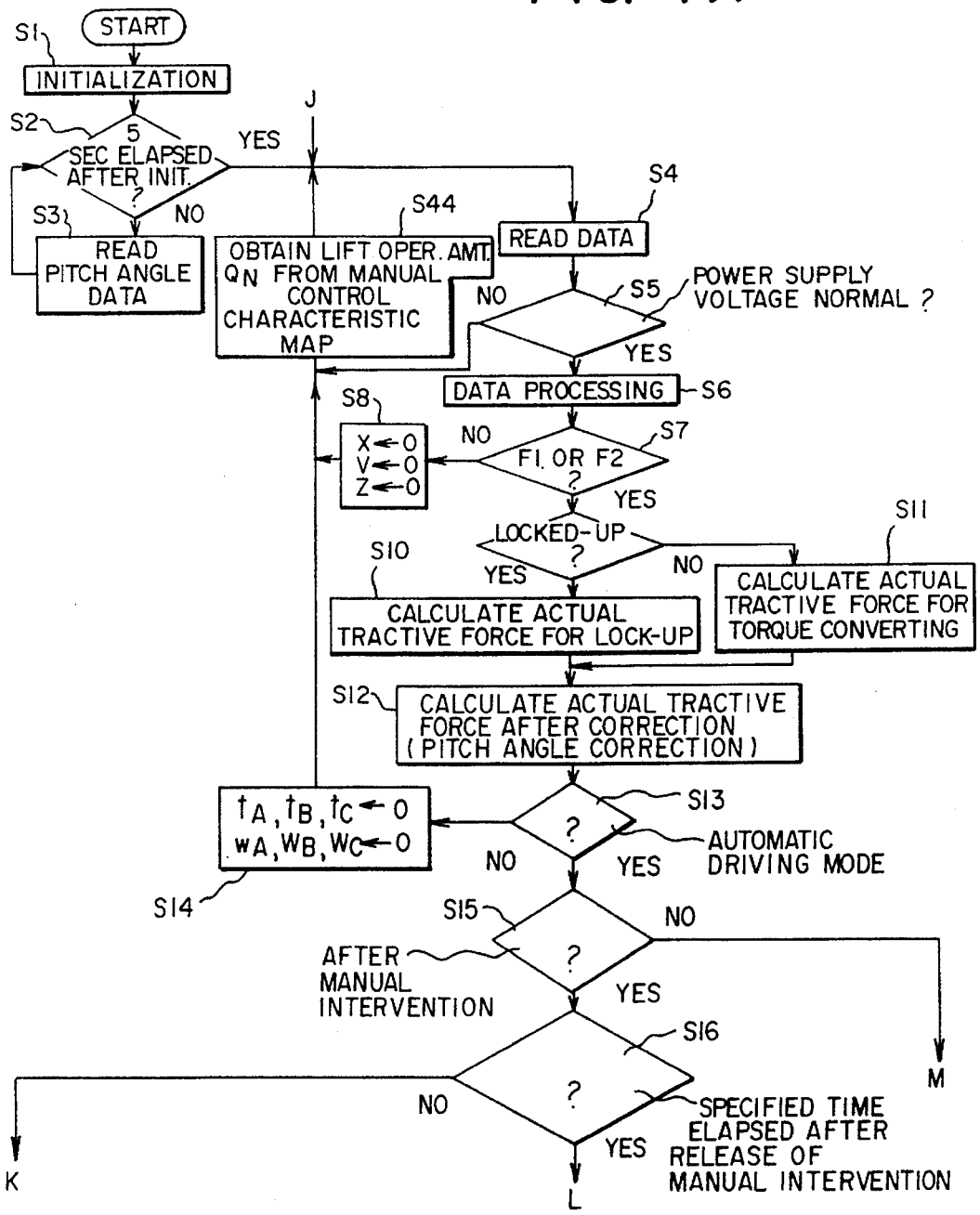
FIGS. 4A and 4B are a flowchart of a dozing program.
Figure 4B:
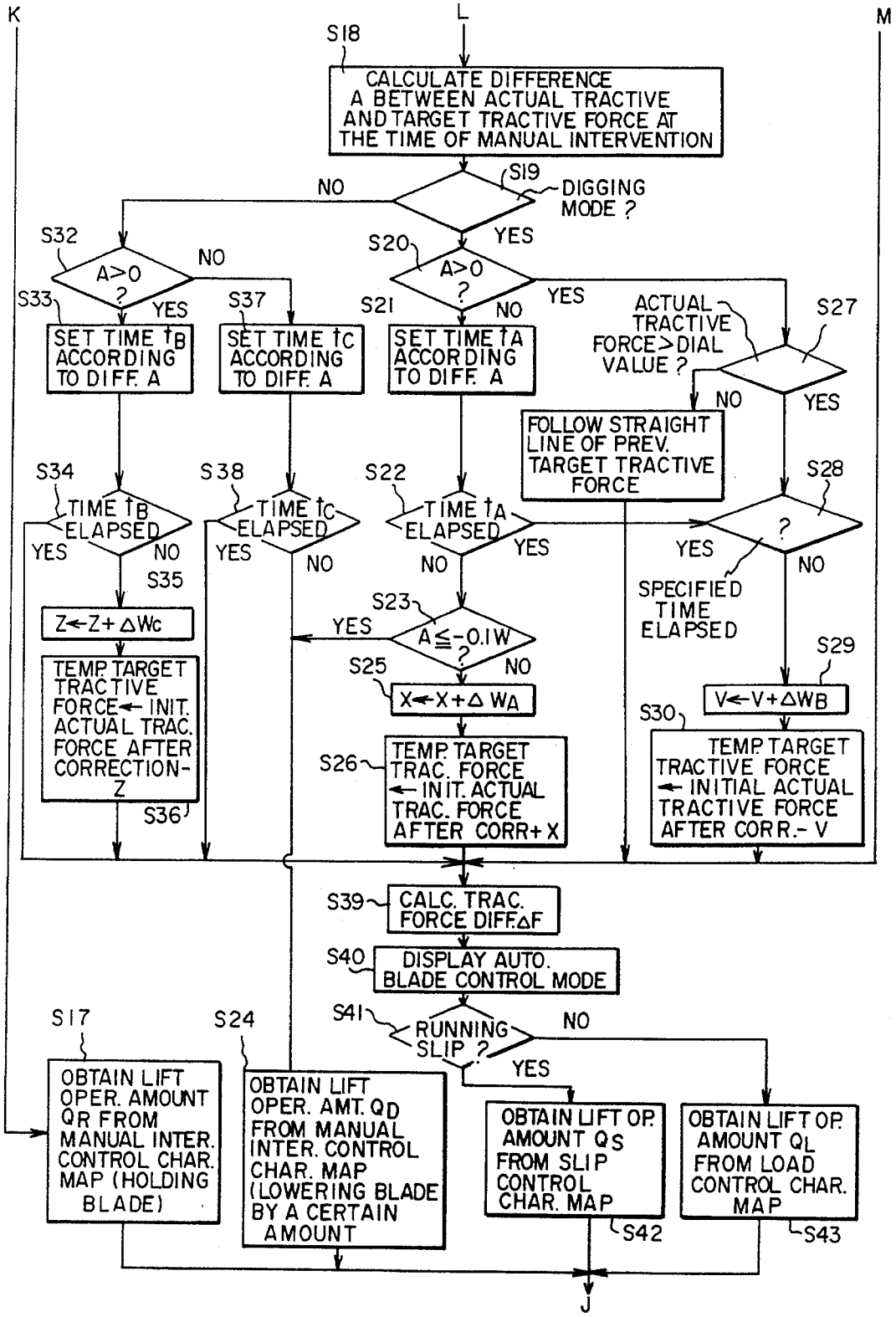

Now reference is made to the flowchart of FIG. 4 for describing, in detail, the performance of the above-described control unit for controlling load in a bulldozer in the case of manual intervention.

Step 1 to Step 3: Power is loaded to start execution of the specified program and to execute initialization by clearing all the data of the registers and so on in the RAM 41C of the microcomputer 41. For a specified time (5 seconds in this embodiment) after the initialization, pitch angle data are sequentially read from the pitch angle sensor 42 as initial values. The reason why pitch angle data are sequentially read as initial values is that the pitch angle of the vehicle body 2 is obtained by frequency separation using the moving average of the pitch angle data.

Step 4 to Step 6: The following data are firstly read: (i) the dial value data sent from the first dial switch 19A, regarding a set load to be applied to the blade 7; (ii) the dial value data sent from the second dial switch 19B, regarding a correction value to be added to or subtracted from the set load; (iii) the data from the driving mode selector button 22, regarding the pressing operation condition; (iv) the data from the engine revolution sensor 37, regarding the revolution speed of the engine 30; (v) the data from the torque convertor output shaft revolution sensor 38, regarding the revolution speed of the output shaft of the torque convertor 33; (vi) the data from the pitch angle sensor 42, regarding the pitch angle of the vehicle body 2 in forward and backward directions; (vii) the data from the transmission speed range sensor 43, regarding the speed range selecting condition of the transmission 34; (viii) the data from the blade operation sensor 44, regarding whether or not the blade 7 is in manual operation; and (ix) the data from the torque LU/TC sensor 45, regarding the locked-up (LU)/torque converting (TC) condition of the torque converter 33. Then, if the voltage of the power source is normal, i.e., more than a specified value and the electronic circuit and so on is in a normal driving condition, the following data processing is executed.

1. Low frequency components are derived from the sequentially read pitch angle data by frequency separation, utilizing the method of moving averages, whereby the pitch angle of the vehicle body 2 is obtained.
2. Then, acceleration components are derived by frequency separation, specifically, by subtracting the above low frequency components from the pitch angle data sequentially read, whereby the acceleration of the vehicle body 2 is obtained.

Step 7 to Step 12: When the speed range selected in the transmission 34 is the first forward speed (F1) or the second forward speed (F2), an actual tractive force $F_R$ is calculated in either of the following methods selected depending on whether the torque converter 33 is in the state of "locked-up" or "torque converting".

1. "Locked-up"

Figure 5:
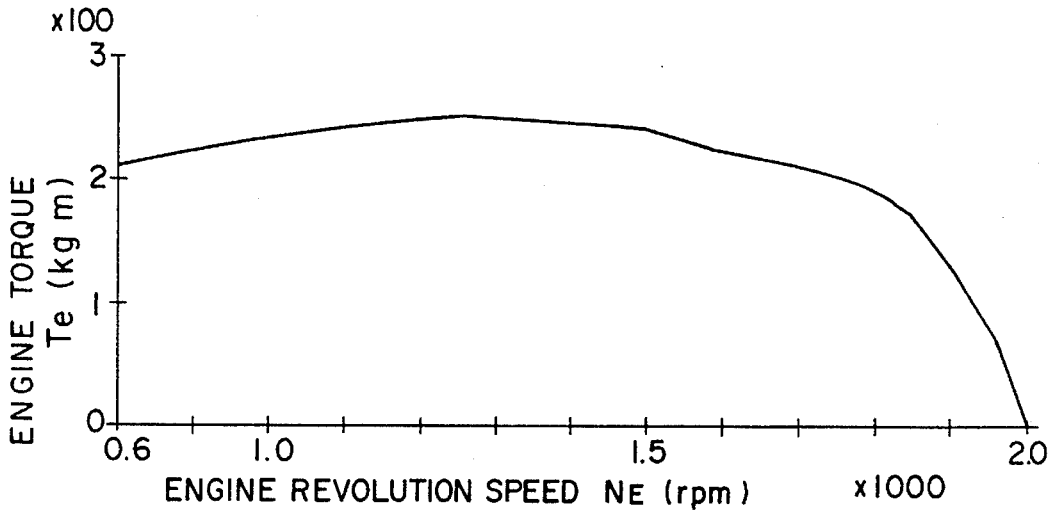
Figure 6:
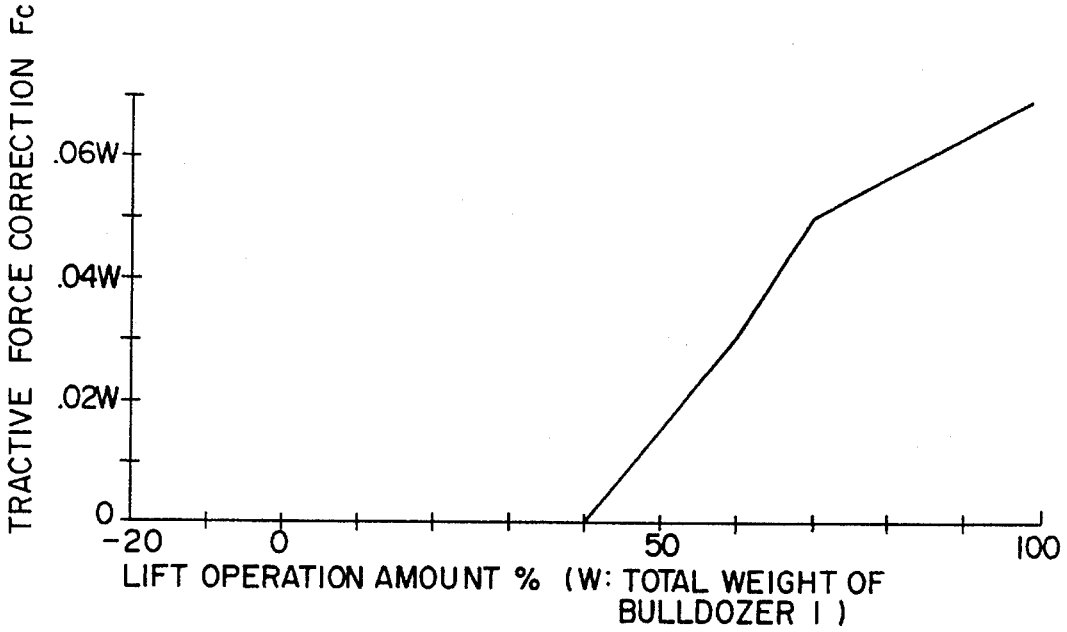

Engine torque Te is obtained from the curved engine characteristic map as shown in FIG. 5, using the revolution speed Ne of the engine 30. Then, the engine torque Te is multiplied by a reduction ratio $k_{se}$ provided over the range of the transmission 34, the steering mechanism 35 and the final reduction mechanisms 36 (in other words, the reduction ratio between the output shaft of the torque convertor 33 and the sprockets 6) and further multiplied by the diameter r of the sprocket 6, to thereby obtain a tractive force Fe ($=Te\times k_{se}\times r$). A tractive force correction value Fc is subtracted from the tractive force Fe, thereby obtaining an actual tractive force $F_R$ ($=Fe-Fc$). The tractive force correction value Fc corresponds to the consumption amount of the hydraulic pumps including operation pumps working on the blade lift cylinders 11 and so on in the PTO 32, and can be obtained from the pump correction characteristic map as shown in FIG. 6, using the lift operation amount of the blade 7.

2. "Torque converting"

Figure 7:
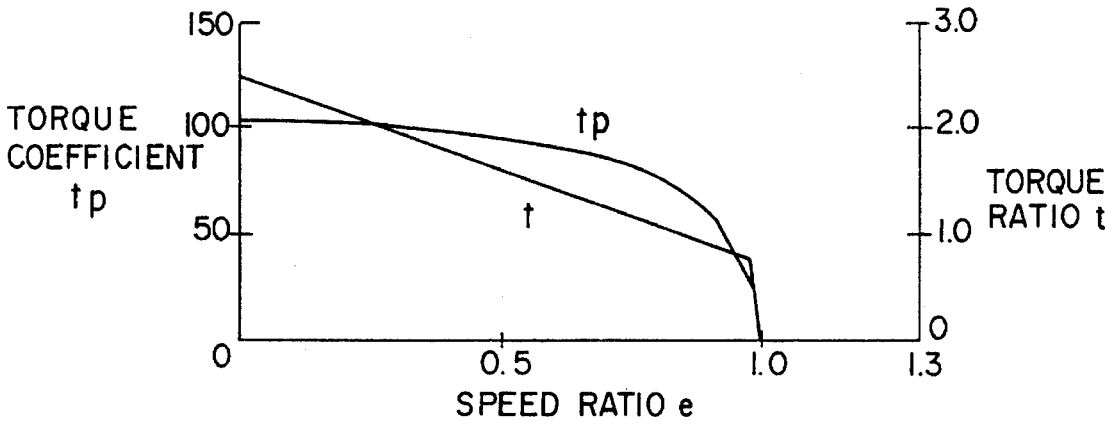

A torque coefficient $t_p$ and torque ratio t are obtained from the curved torque convertor characteristic map as shown in FIG. 7, using the speed ratio e ($=Nt/Ne$) that is the ratio of the revolution speed Ne of the engine 30 to the revolution speed Nt of the output shaft of the torque convertor 33, and then torque convertor output torque Tc ($=t_p\times(Ne/1000)^2\times t$)

is obtained. Like the case 1, the torque convertor output torque Tc is multiplied by the reduction ratio $k_{se}$ between the output shaft of the torque convertor 33 and the sprockets 6 and further multiplied by the diameter r of the sprocket 6, to thereby obtain an actual tractive force $F_R$ (=Tc×$k_{se}$×r).

Figure 8:
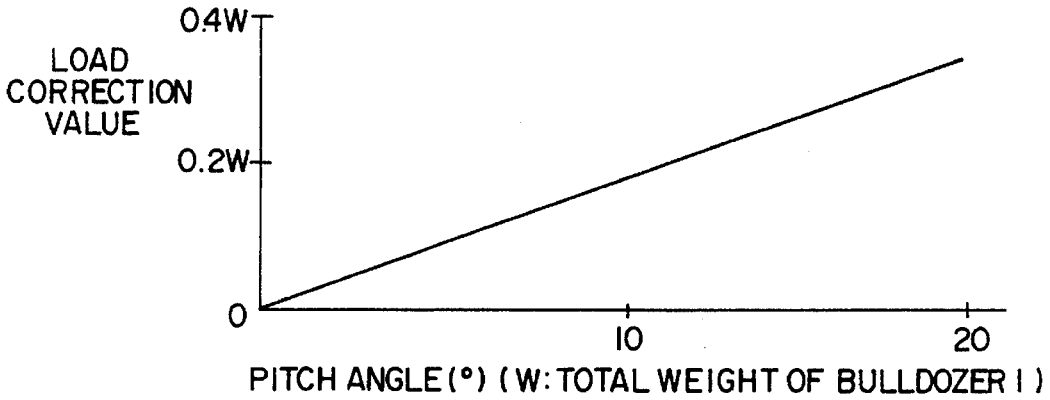

A load correction value, which corresponds to the pitch angle of the vehicle body 2 and can be obtained from the pitch angle-load correction value characteristic map as shown in FIG. 8, is subtracted from the actual tractive force $F_R$ thus obtained, thereby obtaining an actual tractive force after correction F.

If the speed range selected by the transmission 34 is neither the first forward speed (F1) nor the second forward speed (F2), cumulative values X, V and Z which are used for calculation are set to "0" so that the actual tractive force gradually comes closer to a target tractive force which corresponds to the dial value set by the first dial switch 19A for determining the magnitude of a load on the blade 7 when the automatic digging mode is selected.

Step 13 to Step 17: If the number of pressing operations executed by the driving mode selector button 22 is 0 or 3, it is judged that the manual operation mode has been selected and timers $t_A$, $t_B$, $t_C$ (to be described later) and the values of unit tractive force components $\Delta W_A$, $\Delta W_B$, $\Delta W_C$ are set to "0".

If the number of pressing operations executed by the driving mode selector button 22 is 1 (automatic digging mode) or 2 (automatic carrying mode), it is judged that one of the automatic blade control modes has been selected. In cases where the above automatic blade control mode is one selected after the operator has intervened for manual operation and a predetermined time (=4 sec. in this embodiment) has not elapsed after the release of the operator intervention (i.e., after return from the manual operation mode to the automatic blade control mode), a lift operation amount $Q_R$ for holding the blade 7 is obtained from a manual intervention control characteristic map (not shown). With this arrangement, the intention of the operator, to intervene for manual operation, is respected for a while so that the blade 7 is not moved abruptly to reach its set position for the automatic blade control mode as soon as switching to the automatic blade control takes place.

Step 18 to Step 31: If the predetermined time (i.e., 4 seconds) has elapsed after the release of the manual intervention, the difference A between an initial actual tractive force after correction F' obtained just after the release of the manual intervention (i.e., just after the return to the automatic blade control mode) and a target tractive force at the time of the manual intervention is calculated. If the driving mode resumed after releasing the manual intervention is the automatic digging mode, the program proceeds to one of the following steps, according to whether or not the difference between the initial actual tractive force after correction F' obtained just after releasing the manual intervention and the target tractive force at the time of the manual intervention exceeds "0" (i.e., A>0 or A≦0), in other words, according to whether or not the initial actual tractive force after correction F' exceeds the target tractive force at the time of the manual intervention. Note that the time required for repeating the program is 20 milliseconds in this embodiment.

I. Where the initial actual tractive force after correction F' does not exceed the target tractive force at the time of the manual intervention (A≦0):

It is judged that the blade 7 is being manually lifted by the operator, releasing the load applied to the blade 7. Therefore, time $t_A$ required for the actual tractive force after correction F to return to the target tractive force at the time of the manual intervention is set in accordance with the difference A (e.g., $t_A$=A×20), and the program proceeds to either of the following steps depending on whether the time $t_A$ has elapsed.

(i) If the time $t_A$ has not elapsed:

If the difference A is not within a specified value (= ±0.1 W (W: total weight of the bulldozer 1) in this embodiment), i.e., A≦−0.1 W, it is judged that the blade 7 has been lifted high by manual intervention so that there is little soil in the blade 7, and therefore, a lift operation amount $Q_D$ by which the blade 7 is lowered is obtained from the manual intervention control characteristic map (not shown). The degree to which the blade 7 is lowered is, for example, −37% when it is converted to the lowering stroke of the blade control lever 18. Note that an insensitive zone where the movement of the blade control lever 18 is not reflected to the movement of the blade 7 exists up to −30% of the stroke of the blade control lever 18. Taking this into account, it is understood that −37% represents a zone where the blade 7 slightly moves. As the blade 7 is gradually lowered, the load applied to the blade 7 gradually increases.

On the other hand, if the difference A falls in the specified value (i.e., A>−0.1 W), a temporary tractive force $F_0$, with which the actual tractive force after correction F comes closer to the target tractive force at the time of the manual intervention each time the program is executed, is obtained from the following calculation, based on the cumulative value X of the unit tractive force components $\Delta W_A$ which are set in accordance with the time $t_A$.

Temporary target tractive force $F_0$←initial actual tractive force after correction F'+cumulative value X (ii) If the time $t_A$ has elapsed:

It is judged that all the processes from Step 24 to Step 26 have been completed.

II. Where the initial actual tractive force after correction F' exceeds the target tractive force at the time of the manual intervention (A>0):

It is judged that the blade 7 is being lowered by manual intervention which takes place during the operation in the automatic blade control mode so that the load applied to the blade 7 is increasing. Therefore, the program proceeds to either of the following processes, according to whether or not the initial actual tractive force after correction F' obtained just after the release of the manual intervention is greater than a dial value set by the first dial switch 19A and corresponding to the load to be applied to the blade 7.

(i) If the initial actual tractive force after correction F' exceeds the dial value:

If a preset time taken for bringing the target tractive force to the dial value has not elapsed, the temporary target tractive force $F_0$, with which the actual tractive force after correction F comes closer to the dial value each time the program is executed, is sequentially obtained from the following calculation, based on the cumulative value V of the unit tractive force components $\Delta W_B$.

Temporary target tractive force $F_0$←initial actual tractive force after correction F'−cumulative value V On the other hand, if the preset time has elapsed, it is judged that the processes of Step 29 and Step 30 have been completed.

(ii) If the initial actual tractive force after correction F' does not exceed the dial value:

The target tractive force at the time of the manual intervention is set as a target tractive force, and then, the set target tractive force is increased in accordance with the straight line which shows the change as the target tractive force gradually comes closer to the dial value.

Step 32 to Step 38: If the driving mode resumed after releasing the manual intervention is a driving mode other than the automatic digging mode, the program proceeds to either of the following processes, according to whether or not the difference A between the initial actual tractive force after correction F' obtained just after releasing the manual intervention and the target tractive force at the time of the manual intervention exceeds 0 (i.e., A>0 or A≦0), in other words, according to whether or not the initial actual tractive force after correction F' exceeds the target tractive force at the time of the manual intervention. Modes other than the automatic digging mode mentioned herein are the automatic carrying mode and the automatic digging/carrying mode. The automatic digging/carrying mode is a driving mode with which the lifting/lowering operation of the blade 7 is scarcely carried out when the actual tractive force is substantially equal to the target tractive force in the automatic digging mode, and with which digging and carrying are both carried out stably.

I. Where the initial actual tractive force after correction F' exceeds the target tractive force at the time of the manual intervention (A>0):

It is judged that the blade 7 is being manually lowered by the operator so that the load applied to the blade 7 is increasing. Therefore, time $t_B$ required for the actual tractive force after correction F to return to the target tractive force at the time of the manual intervention (e.g., $t_B$=A×20) is set according to the difference A (irrespective of whether the first forward speed or the second forward speed is selected), and then the program proceeds to either of the following processes depending on whether the time $t_B$ has elapsed.

(i) If the time $t_B$ has not elapsed:

The temporary target tractive force $F_0$, with which the target tractive force at the time of the manual intervention comes closer to the actual tractive force after correction F each time the program is executed, is obtained from the following calculation, based on the cumulative value Z of the unit tractive force components $\Delta W_C$ which are set in accordance with the time $t_B$.

Temporary target tractive force $F_0$←initial actual tractive force after correction F'−cumulative value Z (ii) If the time $t_B$ has elapsed:

It is judged that the processes of Step 35 and Step 36 have been completed.

II. Where the initial actual tractive force after correction F' does not exceed the target tractive force at the time of the manual intervention (A≦0):

It is judged that the blade 7 is being manually lifted by the operator, releasing the load applied to the blade 7. Therefore, time $t_C$ required for the actual tractive force after correction F to return to the target tractive force at the time of the manual intervention is set according to the difference A and according to whether the speed range presently selected is the first forward speed or the second forward speed. The time $t_C$ is set to a greater value when the second forward speed is selected than when the first forward speed is selected. More specifically, the time $t_C$ set when the speed of the vehicle is high takes a greater value than that when the speed of the vehicle is low. When the time $t_C$ has not elapsed, the program proceeds to Step 24 in which the lift operation amount $Q_D$ by which the blade 7 is lowered is obtained from the manual intervention control characteristic map (not shown) in order to gradually lower the blade 7 with the load applied thereto gradually increasing. On the other hand, when the time $t_C$ has elapsed, it is judged that the process of Step 24 has been completed.

Step 39 to Step 40: The tractive force difference ΔF between the target tractive force and the actual tractive force after correction is obtained and the display unit 21 indicates the driving mode of dozing operation, i.e., the manual operation mode, the automatic digging mode or the automatic carrying mode.

Step 41 to Step 43: The shoe slip (i.e., running slip) of the vehicle body 2 is detected as "running slip", based on the following conditions, from moving average acceleration ε and the actual tractive force after correction F. The moving average acceleration ε is obtained by applying the method of moving averages to the acceleration of the vehicle body 2 which has been obtained from the acceleration components derived from the pitch angle data by frequency separation.

1. If either of the following conditions are satisfied, the occurrence of running slip is admitted.

(1°=0.0174 G)

(1) the moving average acceleration ε<−4° or (2) the moving average acceleration ε<−2° and the actual tractive force after correction F>0.6 W 2. If either of the following conditions are satisfied, it is admitted that running slip has stopped after occurrence.

(1) the moving average acceleration ε>0.1° or (2) the actual tractive force after correction F> the actual tractive force after correction at the start of running slip F−0.1 W After judging whether or not running slip has occurred based on the foregoing conditions, either of the following steps will be taken in accordance with the judgment.

1. If it is judged that running slip has occurred, a lift operation amount $Q_S$ for lifting the blade 7 is obtained from a slip control characteristic map (not shown) in order to eliminate the running slip by reducing the load applied to the blade 7.

Figure 9:
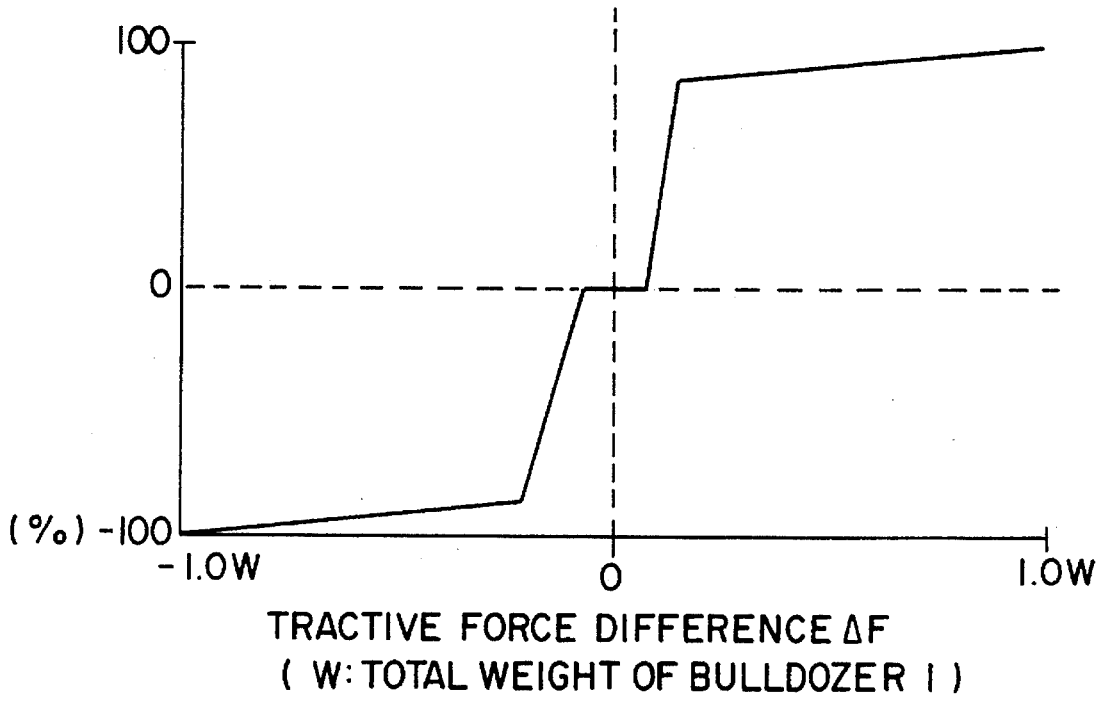

2. If it is judged that no running slip has been detected, a lift operation amount $Q_L$ for lifting or lowering the blade 7 such that the actual tractive force after correction F becomes equal to the target tractive force $F_0$ is obtained from the load control characteristic map shown in FIG. 9, using the tractive force difference ΔF between the target tractive force $F_0$ and the actual tractive force after correction F.

When the voltage of the power source is not normal, being less than the specified value and the functions of the electronic circuit and so on being abnormal; when the transmission 34 is in other gear conditions than the first forward speed (F1) or the second forward speed (F2); or when the manual operation mode is selected, a lift operation amount $Q_N$ for lifting or lowering the blade 7 is obtained from a manual control characteristic map (not shown), according to the operation amount of the blade control lever 18 in Step 44.

The data on the above-mentioned lift operation amounts $Q_S$, $Q_L$, $Q_D$, $Q_R$ and $Q_N$ are supplied to the blade lift cylinder controller 46 which actuates the blade lift cylinders 11 through the lift valve actuator 47 and the lift cylinder operation valve 48 in accordance with the lift operation amounts $Q_S$, $Q_L$, $Q_D$, $Q_R$ and $Q_N$, thereby performing the desired control of lifting or lowering the blade 7.

In Steps 37, 38 and 24 in the foregoing embodiment, when the initial actual tractive force after correction F' does not exceed the target tractive force at the time of the manual intervention, the blade 7 is lowered by a specified degree during the time $t_C$ which is set according to the difference A between the initial actual tractive force after correction F' and the target tractive force and according to a selected speed range (F1 or F2). However, the invention is not necessarily limited to the above arrangement but may be designed such that the CPU generates commands to proceed to different processes, depending on the degree of the difference A. More specifically, if the difference A is within a specified value (±0.05), i.e., $A \geqq -0.05$ W, the value of the target tractive force is gradually increased and if the difference A is not within the specified value i.e., $A < -0.05$ W, the blade 7 is lowered by a specified degree. Further, the set value for the time $t_C$ may be varied according to a selected speed range and may be arranged such that the time $t_C$ becomes shorter as the actual tractive force is increased. One example of the set value for the time $t_C$ in such a case is as follows.

(i) When the first forward speed (F1) is selected:

Actual tractive force$\leqq$0.5 W: $t_C$=difference A×20

Actual tractive force>0.5 W: $t_C$=difference A×10

(ii) When the second forward speed (F2) is selected:

Actual tractive force$\leqq$0.5 W: $t_C$=difference A×60

Actual tractive force>0.5 W: $t_C$=difference A×16

Although the actual tractive force is obtained by calculation when it is detected in the embodiment, the actual tractive force could be obtained from the amount of driving torque detected by setting a driving torque sensor for detecting the driving torque of the sprockets 6. Another alternative is that the actual tractive force could be obtained based on the magnitude of bending stress detected by setting a bending stress sensor for detecting bending stress that is exerted on the trunnions 10 by the straight frames 8 for supporting the blade 7.

In the foregoing embodiment, the invention has been particularly described with the power transmission system equipped with the torque convertor 33 having a lock-up mechanism, but the invention is not necessarily limited to this as it may be applied to cases where a torque convertor having no lock-up mechanism or a direct transmission having no torque convertor is employed. When such a direct transmission is employed, the actual tractive force is calculated in the same way as described in the case of "locked-up" in the foregoing embodiment.

Further, in the embodiment, the running slip of the vehicle body 2 is detected by deriving acceleration components by frequency separation from the pitch angle data output from the pitch angle sensor 42, but it may be detected from an output from an independent acceleration sensor, the output indicating the accelerated condition of the vehicle body 2. Alternatively, a Doppler speed meter may be employed and the running slip is detected by comparing the actual speed of the vehicle body 2 measured by the Doppler speed meter with the traveling speed of the crawler belts 5 used for running the vehicle body 2.

It is possible in the embodiment that the first dial switch 19A is used as a soil property mode switch for selecting the property of soil to be dug such as, for example, sandy soil, gravel soil or soft rock and the load to be applied to the blade 7 Is set in accordance with a selected soil property mode.

Further, in the embodiment, the set magnitude of a load on the blade 7 may be possibly increased or decreased by learning function such as to obtain an optimum frequency for the running slip (shoe slip) of the vehicle body 2 of the bulldozer 1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A control unit for controlling load on a bulldozer in the case of manual intervention, comprising:

actual tractive force detector means for detecting the actual tractive force of a vehicle body;

target tractive force setting means for setting a target tractive force for an automatic blade control mode in dozing operation in accordance with the actual tractive force detected by the actual tractive force detector means; and blade controller means for controlling a blade to be lifted or lowered such that if there is a difference between the target tractive force set by the target tractive force setting means, when switching from the automatic blade control mode to a manual operation mode takes place, in dozing operation, and the actual tractive force detected by the actual tractive force detector means, when return from the manual operation mode to the automatic blade control mode takes place, the actual tractive force gradually comes closer to the target tractive force set when switching to the manual operation mode takes place, wherein the blade controller means controls the blade to be held in a predetermined position for a specified time after return from the manual operation mode to the automatic blade control mode has taken place.

2. The control unit for controlling load on a bulldozer in the case of manual intervention as set forth in claim 1, wherein the actual tractive force detector means includes an engine revolution sensor for detecting the revolution speed Ne of an engine and a torque convertor output shaft revolution sensor for detecting the revolution speed Nt of an output shaft of a torque convertor, and the actual tractive force of the vehicle body is detected by such a calculation that a speed ratio e, which is the ratio of the engine revolution speed Ne detected by the engine revolution sensor to the torque convertor output shaft revolution speed Nt detected by the torque convertor output shaft revolution sensor, is first obtained; torque convertor output torque is obtained from the torque convertor characteristic of the torque convertor, using the speed ratio e; and the torque convertor output torque thus obtained is multiplied by a reduction ratio between the output shaft of the torque convertor and sprockets for driving crawler belts used for running the vehicle body.

3. The control unit for controlling load on a bulldozer in the case of manual intervention as set forth in claim 1, wherein the actual tractive force detector means includes an engine revolution sensor used for detecting the revolution speed of an engine when a torque convertor equipped with a lock-up mechanism is locked up or when a direct transmission is employed, and the actual tractive force of the vehicle body is detected by such a calculation that engine torque is first obtained from the engine torque characteristic of the engine, using the revolution speed of the engine detected by the engine revolution sensor; and then the engine torque thus obtained is multiplied basically by a reduction ratio between the engine and sprockets for driving crawler belts used for running the vehicle body.

4. The control unit for controlling load on a bulldozer in the case of manual intervention as set forth in claim 2 or 3, wherein the actual tractive force detector means further includes a pitch angle sensor for detecting the pitch angle of the vehicle body inclining in forward and backward directions, and an actual tractive force detected based on the pitch angle detected by the pitch angle sensor is corrected.

5. The control unit for controlling load on a bulldozer in the case of manual intervention as set forth in claim 2, wherein the lifting/lowering control of the blade by the blade controller means is not performed when the blade is manually operated, but performed when the blade is in the automatic blade control mode and a first forward speed or a second forward speed is selected.

6. A control unit for controlling load on a bulldozer in the case of manual intervention, comprising:

actual tractive force detector means for detecting the actual tractive force of a vehicle body;

target tractive force setting means for setting a target tractive force for an automatic blade control mode in dozing operation in accordance with the actual tractive force detected by the actual tractive force detector means; and blade controller means for controlling a blade to be lifted or lowered such that if there is a difference between the target tractive force set by the target tractive force setting means, when switching from the automatic blade control mode to a manual operation mode takes place, in dozing operation, and the actual tractive force detected by the actual tractive force detector means, when return from the manual operation mode to the automatic blade control mode takes place, the actual tractive force gradually comes closer to the target tractive force set when switching to the manual operation mode takes place, wherein there are provided, as the automatic blade control mode, an automatic digging mode associated with digging in dozing operation and an automatic carrying mode associated with carrying in dozing operation.

7. The control unit for controlling load on a bulldozer in the case of manual intervention as set forth in claim 6, wherein the blade controller means gradually lowers the blade for a specified time, if the automatic blade control mode resumed after return from the manual operation mode is the automatic digging mode; if the target tractive force when switching from the automatic blade control mode to the manual operation mode takes place is greater than the actual tractive force when return from the manual operation mode to the automatic blade control mode takes place; and if the difference between the target tractive force when switching from the automatic blade control mode to the manual operation mode takes place and the actual tractive force when return from the manual operation mode to the automatic blade control mode takes place exceeds a specified value.

8. The control unit for controlling load on a bulldozer in the case of manual intervention as set forth in claim 7, wherein the specified time is set according to the difference between the target tractive force, when switching from the automatic blade control mode to the manual operation mode takes place, and the actual tractive force, when return from the manual operation mode to the automatic blade control mode takes place.

9. The control unit for controlling load in a bulldozer in the case of manual intervention as set forth in claim 7, wherein the lifting/lowering control of the blade by the blade controller means is not performed when the blade is manually operated, but performed when the blade is in the automatic blade control mode and a first forward speed or a second forward speed is selected.

10. The control unit for controlling load on a bulldozer in the case of manual intervention as set forth in claim 6, wherein the target tractive force setting means sets the target tractive force so as to gradually increase, being closer to the target tractive force set when switching from the automatic blade control mode to the manual operation mode takes place, if the automatic blade control mode resumed after return from the manual operation mode is the automatic digging mode; if the target tractive force when switching from the automatic blade control mode to the manual operation mode takes place is greater than the actual tractive force when return from the manual operation mode to the automatic blade control mode takes place; and if the difference between the target tractive force when switching from the automatic blade control mode to the manual operation mode takes place and the actual tractive force when return from the manual operation mode to the automatic blade control mode takes place is within a specified value.

11. The control unit for controlling load on a bulldozer in the case of manual intervention as set forth in claim 6, wherein the target tractive force setting means sets the target tractive force equal to the target tractive force set, when switching from the automatic blade control mode to the manual operation mode takes place, if the automatic blade control mode resumed after return from the manual operation mode is the automatic digging mode; and if the target tractive force, when switching from the automatic blade control mode to the manual operation mode takes place, is smaller than the actual tractive force, when return from the manual operation mode to the automatic blade control mode takes place.

12. The control unit for controlling load on a bulldozer in the case of manual intervention as set forth in claim 6, wherein the blade controller means gradually lowers the blade for a specified time, if the automatic blade control mode resumed after return from the manual operation mode is the automatic carrying mode; and if the target tractive force, when switching from the automatic blade control mode to the manual operation mode takes place, is greater than the actual tractive force, when return from the manual operation mode to the automatic blade control mode takes place.

13. The control unit for controlling load on a bulldozer in the case of manual intervention as set forth in claim 12, wherein the specified time is set according to the difference between the target tractive force, when switching from the automatic blade control mode to the manual operation mode takes place, and the actual tractive force, when return from the manual operation mode to the automatic blade control mode takes place, and according to a speed range selected by a transmission.

14. The control unit for controlling load on a bulldozer in the case of manual intervention as set forth in claim 13, wherein the specified time is set to a greater value when a second forward speed is selected than when a first forward speed is selected in the transmission.

15. The control unit for controlling load on a bulldozer in the case of manual intervention as set forth in claim 12, wherein the specified time is set according to the difference between the target tractive force, when switching from the automatic blade control mode to the manual operation mode takes place, and the actual tractive force, when return from the manual operation mode to the automatic blade control mode takes place; according to a speed range selected by a transmission; and according to the magnitude of the actual tractive force detected by the actual tractive force detector means.

16. The control unit for controlling load on a bulldozer in the case of manual intervention as set forth in claim 15, wherein the specified time is set to a greater value when a second forward speed is selected than when a first forward speed is selected in the transmission and set to a smaller value when the actual tractive force is great as compared to when the actual tractive force is small.

17. The control unit for controlling load on a bulldozer in the case of manual intervention as set forth in claim 6, wherein the target tractive force setting means sets the target tractive force so as to gradually decrease, being closer to the target tractive force set, when switching from the automatic blade control mode to the manual operation mode takes place, if the automatic blade control mode resumed after return from the manual operation mode is the automatic carrying mode; and if the target tractive force when switching from the automatic blade control mode to the manual operation mode takes place is smaller than the actual tractive force, when return from the manual operation mode to the automatic blade control mode takes place.

* * * * *